US006586383B2

(12) United States Patent
Hage et al.

(10) Patent No.: US 6,586,383 B2
(45) Date of Patent: Jul. 1, 2003

(54) AIR BLEACHING CATALYSTS WITH MODERATING AGENT

(75) Inventors: Ronald Hage, Vlaardingen (NL); Roelant Mathijs Hermant, Vlaardingen (NL); Jean Hypolites Koek, Vlaardingen (NL); Simon Marinus Veerman, Vlaardingen (NL)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 49 days.

(21) Appl. No.: 10/096,791

(22) Filed: Mar. 13, 2002

(65) Prior Publication Data

US 2003/0054967 A1 Mar. 20, 2003

(30) Foreign Application Priority Data

Mar. 14, 2001 (GB) ..... 0106285

(51) Int. Cl.[7] ..... C11D 3/395
(52) U.S. Cl. ..... 510/375; 510/399
(58) Field of Search ..... 510/302, 309, 510/372, 375

(56) References Cited

U.S. PATENT DOCUMENTS

| | | | | |
|---|---|---|---|---|
| 1,246,339 A | | 11/1917 | Smit | |
| 3,332,882 A | | 7/1967 | Blumbergs et al. | |
| 4,128,494 A | | 12/1978 | Schirmann et al. | |
| 4,217,105 A | * | 8/1980 | Goodman | 8/111 |
| 4,397,757 A | | 8/1983 | Bright et al. | |
| 4,412,934 A | | 11/1983 | Chung et al. | |
| 4,588,531 A | | 5/1986 | Balzer et al. | |
| 4,675,393 A | | 6/1987 | Coxon | |
| 4,728,455 A | | 3/1988 | Rerek | |
| 4,751,015 A | | 6/1988 | Humphreys et al. | |
| 4,908,151 A | * | 3/1990 | Inoue et al. | 252/188.28 |
| 5,244,594 A | | 9/1993 | Favre et al. | |
| 5,601,750 A | | 2/1997 | Domke et al. | |
| 5,622,646 A | | 4/1997 | Scialla et al. | |
| 5,627,239 A | * | 5/1997 | Ching et al. | 525/330.6 |
| 6,140,294 A | | 10/2000 | Delroisse et al. | |
| 6,165,963 A | | 12/2000 | Delroisse et al. | |
| 6,242,409 B1 | | 6/2001 | Appel et al. | |
| 6,245,115 B1 | | 6/2001 | Appel et al. | |
| 6,451,752 B1 | * | 9/2002 | Delroisse et al. | 510/370 |

FOREIGN PATENT DOCUMENTS

| | | | |
|---|---|---|---|
| DE | 197 55 493 | | 6/1999 |
| EP | 0 070 074 | | 7/1982 |
| EP | 0 120 591 | | 2/1984 |
| EP | 0 135 522 | | 12/1984 |
| EP | 0 174 132 | | 8/1985 |
| EP | 0 284 292 | | 3/1988 |
| EP | 0 303 520 | | 8/1988 |
| EP | 0 346 995 | | 6/1989 |
| EP | 0 328 177 | | 8/1989 |
| EP | 0 331 229 | | 9/1989 |
| EP | 0 458 379 | | 5/1991 |
| EP | 0 458 396 | | 5/1991 |
| EP | 0 464 880 | | 5/1991 |
| EP | 0 507 207 A2 | * | 10/1992 |
| EP | 0 909 809 | | 9/1998 |
| EP | 0 999 050 | | 11/1999 |
| GB | 836988 | | 6/1960 |
| GB | 864798 | | 4/1961 |
| GB | 907356 | | 10/1962 |
| GB | 1003310 | | 9/1965 |
| GB | 1 519 351 | | 7/1978 |
| WO | 95/34628 | | 12/1995 |
| WO | 97/48787 | | 12/1997 |
| WO | 98/39098 | | 9/1998 |
| WO | 98/39406 | | 9/1998 |
| WO | 99/65905 | | 12/1999 |
| WO | 00/12667 | | 3/2000 |
| WO | 00/12808 | | 3/2000 |
| WO | 00/15750 | | 3/2000 |
| WO | 00/29537 | | 5/2000 |
| WO | 00/34427 | | 6/2000 |
| WO | 00/52124 | | 9/2000 |
| WO | 00/60045 | | 10/2000 |
| WO | 01/00768 | | 1/2001 |
| WO | WO 01/16268 | * | 3/2001 |
| WO | WO 02/50229 | * | 6/2002 |

* cited by examiner

*Primary Examiner*—Yogendra N. Gupta
*Assistant Examiner*—John M. Petruncio
(74) *Attorney, Agent, or Firm*—Milton L. Honig

(57) ABSTRACT

The invention relates to catalytically bleaching substrates, especially laundry fabrics, with a bleaching catalyst in the presence of an unsaturated surfactant.

21 Claims, No Drawings

AIR BLEACHING CATALYSTS WITH MODERATING AGENT

FIELD OF INVENTION

This invention relates to the protection of an unsaturated surfactant in a bleaching composition.

BACKGROUND OF INVENTION

The use of bleaching catalysts for stain removal has been developed over recent years. The recent discovery that some catalysts are capable of bleaching effectively in the absence of an added peroxyl source has recently become the focus of some interest, for example: W09965905; W00012667; W00012808; W00029537, and, W00060045.

UK patent application 0030877.5, filed Dec. 18, 2000, discloses the use of an unsaturated surfactant as a bleach enhancement catalyst. However, there are stability problems associated with the interaction of the unsaturated surfactant and bleach enhancement catalyst.

SUMMARY OF INVENTION

We have found that in some instances an unsaturated surfactant is degraded by an air bleaching catalyst in a non-desirable way. We have also found that in some instances a peroxyl bleaching catalyst together with a peroxyl species degrades an unsaturated surfactant in a non-desirable way. A solution to this problem is provided by the presence of an antioxidant, the presence of which still permits air bleaching of stains.

The present invention provides a bleaching composition comprising an organic ligand which forms a complex with a transition metal for bleaching a substrate with a group selected from:

a) atmospheric oxygen, the bleaching composition upon addition to an aqueous medium providing an aqueous bleaching medium substantially devoid of a peroxygen bleach or a peroxy-based or peroxyl-generating bleach system; and, b) a peroxygen bleach or source thereof, together with a surfactant having an allylic hydrogen, said surfactant having an HLB of greater than 2, and an antioxidant.

In a preferred embodiment of the present invention is provided a bleaching composition for bleaching a substrate, the bleaching composition comprising:

(i) an organic ligand which forms a complex with a transition metal for bleaching with oxygen sourced from the air;

(ii) 0.01 to 60 wt/wt % of a surfactant having an HLB of greater than 15, the surfactant a sodium salt of an unsaturated carboxylic acid having an allylic hydrogen; and, (iii) 0.001 to 10% wt/wt % of a phenolic antioxidant present in the composition, said bleaching composition comprising less than 2% mMol of peroxide per Kg, wherein upon addition of the bleaching composition to an aqueous solution and in the presence of the substrate and least 10% of any bleaching of the substrate is effected by oxygen sourced from the air.

It is preferred that the bleaching composition is substantially devoid of a peroxygen bleach or a peroxy-based or peroxyl-generating bleach system. Nevertheless, as another aspect of the present invention a peroxyl source may be present such that "air bleaching" is suppressed. Generally, "air bleaching" catalysts are capable of operating in a peroxyl bleaching mode.

The surfactant having an allylic hydrogen has an HLB (hydrophilic/lipophilic balance) greater that 2, more preferably greater than 5, and most preferably greater than 10. Ideally, if the surfactant is a charged species the HLB is greater than 15. For a discussion of HLB the reader is directed to and article by Griffin, W. C. in J. Soc. Cosmetic Chemists Vol. 1 page 311, 1945 and Davies, J. T. and Rideal, E. K. in Interfacial Phenomena, Acad. Press, NY, 1961, pages 371 to 382. The HLB value requirement reflects the importance of the rate of solubility and dispersibility of the surfactant having an allylic hydrogen from the bleaching composition to the aqueous wash medium in conjunction with surface activity towards the substrate being washed. The threshold value of HLB as required excludes compounds that have an allylic which do not have the required surfactant properties, for example linoleaic or oleic acid have an HLB of 0.8.

It is preferred that the surfactant having an allylic hydrogen has a CMC of $2\times10^{-2}$ M or less. It is most preferred that the surfactant is anionic has a critical micelle concentration value of $3\times10^{-3}$ M or less. Generally, a surfactant will form a micelle when present in an aqueous solution above a specific concentration that is intrinsic to the surfactant. A micelle is a neutral or electrically charged colloidal particle, consisting of oriented molecules. Above what is known as the critical micelle concentration CMC amphiphilic compounds tend to adopt specific aggregates in aqueous solution. The tendency is to avoid contact between their hydrophobic alkyl chains and the aqueous environment and to form an internal hydrophobic phase. Such compounds can form monomolecular layers [monolayers] at the air-water boundary and bimolecular layers [bilayers] between two aqueous compartments. Micelles are spherically closed monolayers. This CMC criterion is another aspect that aids reduction of catalyst deposit.

The property required is that the surfactant used in the present invention is and forms a micelle at a concentration of $2\times10^{-2}$ M and below in an aqueous solution at a temperature of 25° C. One skilled in the art will be aware that the standard CMC is measured in deionized water and that the presence of other components in solution, e.g. surfactants or ions in solution will perturb the CMC value. The CMC values and requirement thereof as described herein are measured under standard conditions (N. M. Van Os, J. R.

Haak, and L. A. M Rupert, Pysico Chemical Properties of Selected Anionic Cationic and Nonionic Surfactants Elsevier 1993; Kresheck, G. C. Surfactants-In water a comparative treatise- (ed. F. Franks) Chapter 2 pp 95–197 Plenum Press 1971, New York; and, Mukerjee, P. and Mysels K. J. Critical Micelle Concentrations of Aqueous Surfactant Systems, NSRDS-NBS 36, National Bureau of Standards. U.S. Gov. Print office 1971, Washington, D.C.).

The present invention has particular utility as a bleaching composition in a commercial "air bleaching" liquid and granular "air bleaching" or peroxyl bleaching format. The degradation of unsaturated components during storage in the absence of an antioxidant often results in the formation of mal odour components due to the degradation of unsaturated compounds. The composition also serves to reduce the degradation of unsaturated compounds during the wash.

The composition of the present invention, in an air bleaching mode, is preferably substantially devoid of a peroxygen bleach or a peroxy-based or peroxyl-generating bleach system. The term "substantially devoid of a peroxygen bleach or a peroxy-based or peroxyl-generating bleach system" should be construed within spirit of the invention. It is preferred that the composition has as low a content of a peroxyl species present as possible. Nevertheless, autoxidation is something that is very difficult to avoid and as a result small levels of peroxyl species may be present. These small levels may be as high as 2% but are preferably below 2%. The level of peroxide present is expressed in mMol of hydroperoxide (—OOH) present per Kg.

The additionally added organic compounds having labile CH's, for example allylic, benzylic, —C(O)H, and —CRH—O—R', are particuLarly susceptible to autoxidation and hence may contribute more to this level of peroxyl species than other components. However the presence of an antioxidant in the composition will likely serve to reduce the presence of adventitious peroxyl species by reducing chain reactions. The composition of the present invention bleaches a substrate with at least 10%, preferably at least 50% and optimally at least 90% of any bleaching of the substrate being effected by oxygen sourced from the air.

When only a peroxyacid is present as a peroxyl bleaching species in a bleaching medium with a bleaching catalyst [total peroxyl present]=[RC(O)OOH]+[RC(O)OO$^-$]. When a mixture of hydrogen peroxide and peroxyacid are present in this medium [total peroxyl present]=[RC(O)OOH]+[RC(O)OO$^-$]+[$H_2O_2$]+[HOO$^-$]. In some instances, the peroxy species will be relatively unreactive and hence the dominant conditions for "air bleaching" will be still be met by a relatively high level of peroxyl species present. The different peroxyl species will react at different rates with an "air bleaching catalyst" but what is essential, for "air bleaching mode" is that k[air cat] [peroxyl] is sufficiently small that k[air cat] [O2] dominates to the extent that at least 10% of any bleaching of the substrate is effected by oxygen sourced from the air when the composition is for use in an air bleaching mode. When the composition is used in a peroxy mode there is sufficient peroxy species present to dominate and suppress "air bleaching" in the medium.

The present invention extends to a commercial package comprising the bleaching composition according to the present invention together with instructions for its use.

Any suitable textile that is susceptible to bleaching or one that one might wish to subject to bleaching may be used. Preferably the textile is a laundry fabric or garment.

In a preferred embodiment, the method according to the present invention is carried out on a laundry fabric using an aqueous treatment liquor. In particular, the treatment may be effected in a wash cycle for cleaning laundry. More preferably, the treatment is carried out in an aqueous detergent bleach wash liquid, preferably in a washing machine.

The composition of the present invention whilst providing an improved amount protection to unsaturated compounds permits a bleaching activity of at least 25%, preferably at least 50%, equivalent to same composition devoid of anti-oxidant.

A unit dose as used herein is a particular amount of the bleaching composition used for a type of wash. The unit dose may be in the form of a defined volume of powder, granules or tablet or unit dose detergent liquid.

DETAILED DESCRIPTION OF THE INVENTION

Antioxidant

The compositions of the present invention will comprise an effective amount of the anti-oxidant, preferably from about 0.001% more preferably from about 0.1%, most preferably from about 0.2% to about 10%, preferably to about 5%, more preferably to about 1% by weight of an anti-oxidant. Anti-oxidants are substances as described in Kirk-Othmers (Vol 3, pg 424) and in Uhlmans Encyclopedia (Vol 3, pg 91).

One class of anti-oxidants suitable for use in the present invention is alkylated phenols having the general formula:

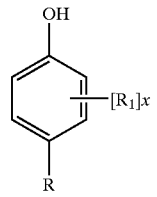

wherein R is C1–C22 linear or branched alkyl, preferably methyl or branched C3–C6 alkyl; C3–C6 alkoxy, preferably methoxy; R1 is a C3–C6 branched alkyl, preferably tert-butyl; x is 1 or 2. Hindered phenolic compounds are preferred as antioxidant.

Another class of anti-oxidants suitable for use in the present invention is a benzofuran or benzopyran derivative having the formula:

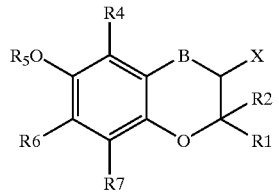

wherein R1 and R2 are each independently alkyl or R1 and R2 can be taken together to form a C5–C6 cyclic hydrocarbyl moiety; B is absent or CH2; R4 is C1–C6 alkyl; R5 is hydrogen or —C(O)R3 wherein R3 is hydrogen or C1–C19 alkyl;

R6 is C1–C6 alkyl; R7 is hydrogen or C1–C6 alkyl; X is —CH2OH, or —CH2A wherein A is a nitrogen comprising unit, phenyl, or substituted phenyl. Preferred nitrogen comprising A units include amino, pyrrolidino, piperidino, morpholino, piperazino, and mixtures thereof.

Other suitable antioxidants are found as follows. A derivative of α-tocopherol, 6-hydroxy-2,5,7,8-tetramethylchroman-2-carboxylic acid (Trolox ). Anti-oxidants/radical scavengers such as ascorbic acid (vitamin C) and its salts, tocopherol (vitamin E), tocopherol sorbate, other esters of tocopherol, butylated hydroxy benzoic acids and their salts, gallic acid and its alkyl esters, especially propyl gallate, uric acid and its salts and alkyl esters, sorbic acid and its salts, the ascorbyl esters of fatty acids, amines (e.g., N,N-diethylhydroxylamine, amino-guanidine), sulfhydryl compounds (e.g., glutathione), and dihydroxy fumaric acid and its salts may be used.

Non-limiting examples of anti-oxidants suitable for use in the present invention include phenols inter alia 2,6-di-tert-butylphenol, 2,6-di-tert-butyl-4-methylphenol, mixtures of 2 and 3- tert-butyl-4-methoxyphenol, and other ingredients including include propyl gallate, tert-butylhydroquinone, benzoic acid derivatives such as methoxy benzoic acid, methylbenzoic acid, dichloro benzoic acid, dimethyl benzoic acid, 5-hydroxy-2,2,4,6,7-pentamethyl-2,3-dihydro-1-benzofuran-3-one, 5-hydroxy-3-methylene-2,2,4,6,7-pentamethyl-2,3-dihydro-benzofuran, 5-benzyloxy-3-hydroxymethyl-2,2,4,6,7-pentamethyl-2,3-dihydro-1-benzofuran, 3-hydroxymethyl-5-methoxy-2,2,4,6,7-pentamethyl-2,3-dihydro-1-benzofuran, vitamin C(ascorbic acid), and Ethoxyquine (1,2-dihydro-6-ethoxy-2,2,4-rimethylchinolin)marketed under the name Raluquin by the company Raschig.

Preferred radical scavengers for use herein include di-tert-butyl hydroxy toluene (BHT), α-tocopherol hydroquinone, 2,2,4-trimethyl-1,2-dihydroquinoline, di-tert-butyl hydroquinone, mono-tert-butyl hydroquinone, tert-butyl-hydroxy anisole, benzoic acid and derivatives thereof, like alkoxylated benzoic acids, as for example, trimethoxy benzoic acid (TMBA), toluic acid, catechol, t-butyl catechol, benzylamine, 1,1,3-tris(2-methyl-4-hydroxy-5-t-butylphenyl) butane, N-propyl-gallate or mixtures thereof and highly preferred is di-tert-butyl hydroxy toluene.

Surfactant Having an Allylic Hydrogen

To benefit from the enhancement of bleaching activity it is preferred that the surfactant having an allylic hydrogen is present in the composition such that a unit dose provides at least 0.01 g/l, more preferably at least 0.5 g/l, and most preferably at least 0.1 g/l , concentration of the unsaturated organic compound in a wash. The surfactant having an allylic hydrogen may be present in the composition in the range of 0.01 to 60%, preferably 0.1 to 20% and most preferably 10% w/w.

There are many classes of surfactants having an allylic hydrogen that will work with the present invention to enhance air bleaching. As one skilled in the art is aware a surfactant having an allylic hydrogen (enhancer) may be found in: neutral species, and charged species, i.e., cationic species, anionic species, and zwitterionic species.

It is preferred that the surfactant having an allylic hydrogen contains a hydrophilic group thereby providing the organic compound unassociated or as a micelle in an aqueous medium. It also is preferred that the surfactant having an allylic hydrogen is provided in the form of an alkali metal salt, preferably sodium, of an unsaturated carboxylic acid.

One skilled in the art will appreciate that benzene and toluene are considered unsaturated but neither possess allylic hydrogens per se. The homolytic bond dissociation energy (BDE) for benzene (C6H5-H) is 110.9 kcal/mol (298 K) makes benzene moieties per se unsuitable to promote enhanced bleaching. The surfactant used to enhance bleaching according to the present invention has a hydrogen atom covalently bound to an alpha-carbon that is alpha to a Sp2—Sp2 hybridized bond (other than Sp2—Sp2 hybridized bonds found in a cyclic aromatic system) e.g., as shown as underlined in the following formula CH2=CH–C H2–CH3. It is most preferred that the surfactant having an allylic hydrogen has a molecular weight of at least 80 and a bond dissociation energy of less than 95 kcal/mol, most preferably below 90 kcal/mol, and even more preferably below 85 kcal/mol. Below is a table of bond strengths (298 K) obtained from: The handbook of Chemistry and Physics 73$^{rd}$ edition, CRC Press.

| Compound | BDE ΔH(kcal/mol) |
|---|---|
| (CH3)3CH | 93.3 ± 0.5 |
| H—CH2OCH3) | 93 ± 1 |
| C6H5—H | 110.9 ± 2.0 |
| H—CMe2OH | 91 ± 1 |

-continued

| Compound | BDE ΔH(kcal/mol) |
|---|---|
| CH3CH3 | 100.3 ± 1 |
| CH2=CH—CH2—CH3 | 83.1 ± 2.2 |
| CH2=CH—CH3 | 86.3 ± 1.5 |
| C6H5—CH3 | 88.0 ± 1 |
| CH3CH=CHCH=CH2 | 83 ± 3 |

1) Unsaturated Soap (Unsaturated Anionic Surfactant)

The unsaturated fatty acid soap used preferably contains from about 16 to about 22 carbon atoms, Preferably in a straight chain configuration. Preferably the number of carbon atoms in the unsaturated fatty acid soap is from about 16 to about 18.

This unsaturated soap, in common with other anionic detergents and other anionic materials in the detergent compositions of this invention, has a cation, which renders the soap water-soluble and/or dispersible. Suitable cations include sodium, potassium, ammonium, monethanolammonium, diethanolammonium, triethanolammonium, tetramethylammonium, etc. cations. Sodium ions are preferred although in liquid formulations potassium, monoethanolammonium, diethanolammonium, and triethanolammonium cations are useful.

The unsaturated soaps are made from natural oils that often contain one or more unsaturated groups and consist of mixtures of components. It is clear that hydrolysation of these natural components yield mixtures of soaps, of which at least one of the components contain one or more unsaturated groups. Examples of natural oils are sunflower oil, olive oil, cottonseed oil, linseed oil, safflower oil, sesame oil, palm oil, corn oil, peanut oil, soybean oil, castor oil, coconut oil, canola oil, cod liver oil and the like, that give mixtures of soaps of which at least one of them has at least one unsaturated group. However, also hydrolysis products of purified oils, as listed above, may be employed. Other examples of soaps include thoses derived from erucic acid, 2) Unsaturated Surfactant (Unsaturated Cationic)

As one skilled in the art will appreciate such an unsaturated cationic may be manufactured, for example, by adding an unsaturated alkyl halide to an amine thus forming an unsaturated cationic.

In principle the cationic surfactants exhibit the same requirements as listed above for the unsaturated soap materials, except they need to be quarternised. Without limiting the scope of the invention, suitable cationics may be formed by preparing the quaternary salts from alcohols that were obtained from the corresponding fatty acid (as defined under 1; from oils containing unsaturated bonds).

Examples of cationic surfactants based on natural oils include oleylbis(2-hydroxyethyl)methylammonium chloride and ditallow fatty alkyldimethyl ammonium chloride.

3) Unsaturated Neutral Surfactant

An example of a non-ionic (neutral) surfactant is found in alkoxylated non-ionic surfactants. In common with the ionic surfactants as described above the surfactant has an allylic hydrogen.

Bleach Catalyst

The bleach catalyst per se may be selected from a wide range of organic molecules (ligands) and complexes thereof. Suitable organic molecules (ligands) and complexes for use with the present invention are found, for example in: GB 9906474.3; GB 9907714.1; GB 98309168.7, GB 98309169.5; GB 9027415.0 and GB 9907713.3; DE 19755493; EP 999050; WO-A-9534628; EP-A-458379; EP 0909809; U.S. Pat. No. 4,728,455; WO-A-98/39098; WO-A-98/39406, WO 9748787, WO 0029537; WO 0052124, and WO 0060045 the complexes and organic molecule (ligand) precursors of which are herein incorporated by reference. The air bleaching catalysts as used herein should not be construed as an peroxyl-generating system, alone or in combination with other substrates, irrespective of how they bleaching action works.

Another example of an air bleaching catalyst is a ligand or transition metal catalyst thereof of a ligand having the formula (I):

(I)

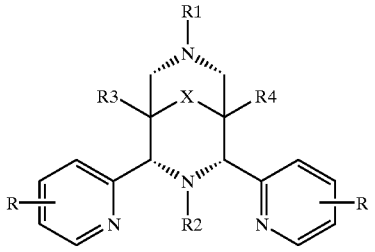

wherein each R is independently selected from: hydrogen, hydroxyl, and C1–C4-alkyl;

R1 and R2 are independently selected from:

C1–C4-alkyl,

C6–C10-aryl, and, a group containing a heteroatom capable of coordinating to a transition metal, wherein at least one of R1 and R2 is the group containing the heteroatom;

R3 and R4 are independently selected from hydrogen, C1–C8 alkyl, C1–C8-alkyl-O-C1–C8-alkyl, C1–C8-alkyl-O-C6–C10-aryl, C6–C10-aryl, C1–C8-hydroxyalkyl, and —$(CH2)_n$C(O)OR5 wherein R5 is C1–C4-alkyl, n is from 0 to 4, and mixtures thereof; and, X is selected from C═O, —$[C(R6)_2]_y$— wherein Y is from 0 to 3 each R6 is independently selected from hydrogen, hydroxyl, C1–C4-alkoxy and C1–C4-alkyl.

It is preferred that the group containing the hetroatom is: a heterocycloalkyl: selected from the group consisting of: pyrrolinyl; pyrrolidinyl; morpholinyl; piperidinyl; piperazinyl; hexamethylene imine; 1,4-piperazinyl; tetrahydrothiophenyl; tetrahydrofuranyl; tetrahydropyranyl; and oxazolidinyl, wherein the heterocycloalkyl may be connected to the ligand via any atom in the ring of the elected heterocycloalkyl, a —C1–C6-alkyl-heterocycloalkyl, wherein the heterocycloalkyl of the —C1–C6-heterocycloalkyl is selected from the group consisting of: piperidinyl; piperidine; 1,4-piperazine,tetrahydrothiophene; tetrahydrofuran; pyrrolidine; and tetrahydropyran, wherein the heterocycloalkyl may be connected to the —C1–C6-alkyl via any atom in the ring of the selected heterocycloalkyl, a —C1–C6-alkyl-heteroaryl, wherein the heteroaryl of the —C1–C6-alkylheteroaryl is selected from the group consisting of: pyridinyl; pyrimidinyl; pyrazinyl; triazolyl; pyridazinyl; 1,3,5-triazinyl; quinolinyl; isoquinolinyl; quinoxalinyl; imidazolyl; pyrazolyl; benzimidazolyl; thiazolyl; oxazolidinyl; pyrrolyl; carbazolyl; indolyl; and isoindolyl, wherein the heteroaryl may be connected to the —C1–C6-alkyl via any atom in the ring of the selected heteroaryl and the selected heteroaryl is optionally substituted by -C1–C4-alkyl, a C0–C6-alkyl-phenol or thiophenol, a C2–C4-alkyl-thiol, thioether or alcohol, a C2–C4-alkyl-amine, and a C2–C4-alkyl-carboxylate.

The ligand forms a complex with one or more transition metals, in the latter case for example as a dinuclear complex. Suitable transition metals include for example: manganese in oxidation states II–V, iron II–V, copper I–III, cobalt I–III, titanium II–IV, tungsten IV–VI, vanadium II–V and molybdenum II–VI.

The transition metal complex preferably is of the general formula (AI):

$$[M_aL_kX_n]Y_m$$

in which:

M represents a metal selected from Mn(II)–(III)–(IV)–(V), Cu(I)–(II)–(III), Fe(II)–(III)–(IV)–(V), Co(I)–(II)–(III), Ti(II)–(III)–(IV), V(II)–(III)–(IV)–(V), Mo(II)–(III)–(IV)–(V)–(VI) and W(IV)–(V)–(VI), preferably from Fe(II)–(III)–(IV)–(V);

L represents the ligand, preferably N,N-bis(pyridin-2-ylmethyl)-1,1-bis(pyridin-2-yl)-1-aminoethane, or its protonated or deprotonated analogue;

X represents a coordinating species selected from any mono, bi or tri charged anions and any neutral molecules able to coordinate the metal in a mono, bi or tridentate manner;

Y represents any non-coordinated counter ion;

a represents an integer from 1 to 10;

k represents an integer from 1 to 10;

n represents zero or an integer from 1 to 10;

m represents zero or an integer from 1 to 20.

It is preferred that the organic molecule (ligand) or transition metal complex is present in the composition such that a unit dose provides at least 0.1 $\mu$M of the organic molecule or transition metal complex thereof.

The present invention may be used in a peroxyl bleaching mode in contrast to an air bleaching mode in which the composition is substantially devoid of a peroxyl source. However it is preferred to use the present invention in an air bleaching mode. In this instance a purely peroxyl bleaching catalyst may be employed in contrast to an air bleaching catalyst.

Peroxygen Bleach or Source Thereof

In a peroxyl bleaching mode the composition of the present invention uses a peroxyl species to bleach a substrate. The peroxy bleaching species may be a compound which is capable of yielding hydrogen peroxide in aqueous solution. Hydrogen peroxide sources are well known in the art. They include the alkali metal peroxides, organic peroxides such as urea peroxide, and inorganic persalts, such as the alkali metal perborates, percarbonates, perphosphates persilicates and persulphates. Mixtures of two or more such compounds may also be suitable.

Particularly preferred are sodium perborate tetrahydrate and, especially, sodium perborate monohydrate. Sodium perborate monohydrate is preferred because of its high active oxygen content. Sodium percarbonate may also be preferred for environmental reasons. The amount thereof in the composition of the invention usually will be within the range of about 1–35% by weight, preferably from 5–25% by weight. One skilled in the art will appreciate that these amounts may be reduced in the presence of a bleach precursor e.g., N,N,N'N'-tetraacetyl ethylene diamine (TAED).

Another suitable hydrogen peroxide generating system is a combination of a C1–C4 alkanol oxidase and a C1–C4 alkanol, especially a combination of methanol oxidase (MOX) and ethanol. Such combinations are disclosed in International Application PCT/EP 94/03003 (Unilever), which is incorporated herein by reference.

Alkylhydroxy peroxides are another class of peroxy bleaching compounds. Examples of these materials include cumene hydroperoxide and t-butyl hydroperoxide.

Organic peroxyacids may also be suitable as the peroxy bleaching compound. Such materials normally have the general formula:

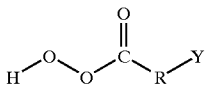

wherein R is an alkylene or substituted alkylene group containing from 1 to about 20 carbon atoms, optionally having an internal amide linkage; or a phenylene or substituted phenylene group; and Y is hydrogen, halogen, alkyl, aryl, an imido-aromatic or non-aromatic group, a COOH or

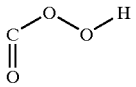

group or a quaternary ammonium group.

Typical monoperoxy acids useful herein include, for example:

(i) peroxybenzoic acid and ring-substituted peroxybenzoic acids, e.g. peroxy-.alpha.-naphthoic acid;

(ii) aliphatic, substituted aliphatic and arylalkyl monoperoxyacids, e.g. peroxylauric acid, peroxystearic acid and N,N-phthaloylaminoperoxy caproic acid (PAP); and (iii) 6-octylamino-6-oxo-peroxyhexanoic acid.

Typical diperoxyacids useful herein include, for example:

(iv) 1,12-diperoxydodecanedioic acid (DPDA);

(v) 1,9-diperoxyazelaic acid;

(vi) diperoxybrassilic acid; diperoxysebasic acid and diperoxyisophthalic acid;

(vii) 2-decyldiperoxybutane-1,4-diotic acid; and (viii) 4,4'-sulphonylbisperoxybenzoic acid.

Also inorganic peroxyacid compounds are suitable, such as for example potassium monopersulphate (MPS). If organic or inorganic peroxyacids are used as the peroxygen compound, the amount thereof will normally be within the range of about 2–10% by weight, preferably from 4–8% by weight. Peroxyacid bleach precursors are known and amply described in literature, such as in the British Patents 836988; 864,798; 907,356; 1,003,310 and 1,519,351; German Patent 3,337,921; EP-A-0185522; EP-A-0174132; EP-A-0120591; and U.S. Pat. Nos. 1,246,339; 3,332,882; 4,128,494; 4,412,934 and 4,675,393.

Another useful class of peroxyacid bleach precursors is that of the cationic i.e. quaternary ammonium substituted peroxyacid precursors as disclosed in U.S. Pat. Nos. 4,751,015 and 4,397,757, in EP-A0284292 and EP-A-331,229. Examples of peroxyacid bleach precursors of this class are:

2-(N,N,N-trimethyl ammonium) ethyl sodium-4-sulphonphenyl carbonate chloride (SPCC);

N-octyl-N,N-dimethyl-N10-carbophenoxy decyl ammonium chloride (ODC);

3-(N,N,N-trimethyl ammonium) propyl sodium-4-sulphophenyl carboxylate; and

N,N,N-trimethyl ammonium toluyloxy benzene sulphonate.

A further special class of bleach precursors is formed by the cationic nitrites as disclosed in EP-A-303,520 and in European Patent Specification No.'s 458,396 and 464,880.

Any one of these peroxyacid bleach precursors can be used in the present invention, though some may be more preferred than others.

Of the above classes of bleach precursors, the preferred classes are the esters, including acyl phenol sulphonates and acyl alkyl phenol sulphonates; the acyl-amides; and the quaternary ammonium substituted peroxyacid precursors including the cationic nitrites.

Examples of said preferred peroxyacid bleach precursors or activators are sodium-4-benzoyloxy benzene sulphonate (SBOBS); N,N,N'N'-tetraacetyl ethylene diamine (TAED); sodium-1-methyl-2-benzoyloxy benzene-4-sulphonate; sodium-4-methyl-3-benzoloxy benzoate; SPCC; trimethyl ammonium toluyloxy-benzene sulphonate; sodium nonanoyloxybenzene sulphonate (SNOBS); sodium 3,5,5-trimethyl hexanoyl-oxybenzene sulphonate (STHOBS); and the substituted cationic nitrites.

Other classes of bleach precursors for use with the present invention are found in W00015750, for example 6-(nonanamidocaproyl)oxybenzene sulphonate.

The precursors may be used in an amount of up to 12%, preferably from 2–10% by weight, of the composition.

The Detergent Composition

The air bleach catalyst and unsaturated organic compound may be used in a detergent composition specifically suited for stain bleaching purposes, and this constitutes a second aspect of the invention. To that extent, the composition comprises a surfactant and optionally other conventional detergent ingredients. The invention in its second aspect provides an enzymatic detergent composition which comprises from 0.1–50% by weight, based on the total detergent composition, of one or more surfactants. This surfactant system may in turn comprise 0–95% by weight of one or more anionic surfactants and 5 to 100% by weight of one or more nonionic surfactants. The surfactant system may additionally contain amphoteric or zwitterionic detergent compounds, but this in not normally desired owing to their relatively high cost. The enzymatic detergent composition according to the invention will generally be used as a dilution in water of about 0.05 to 2%.

In general, the nonionic and anionic surfactants of the surfactant system may be chosen from the surfactants described "Surface Active Agents" Vol. 1, by Schwartz & Perry, Interscience 1949, Vol. 2 by Schwartz, Perry & Berch, Interscience 1958, in the current edition of "McCutcheon's Emulsifiers and Detergents" published by Manufacturing Confectioners Company or in "Tenside-Taschenbuch", H. Stache, 2nd Edn., Carl Hauser Verlag, 1981.

Suitable nonionic detergent compounds which may be used include, in particular, the reaction products of compounds having a hydrophobic group and a reactive hydrogen atom, for example, aliphatic alcohols, acids, amides or alkyl phenols with alkylene oxides, especially ethylene oxide either alone or with propylene oxide. Specific nonionic detergent compounds are $C_6$–$C_{22}$ alkyl phenol-ethylene oxide condensates, generally 5 to 25 EO, i.e. 5 to 25 units of ethylene oxide per molecule, and the condensation products of aliphatic $C_8$–$C_{18}$ primary or secondary linear or branched alcohols with ethylene oxide, generally 5 to 40 EO.

Suitable anionic detergent compounds which may be used are usually water-soluble alkali metal salts of organic sulphates and sulphonates having alkyl radicals containing from about 8 to about 22 carbon atoms, the term alkyl being used to include the alkyl portion of higher acyl radicals.

Examples of suitable synthetic anionic detergent compounds are sodium and potassium alkyl sulphates, especially those obtained by sulphating higher $C_8$–$C_{18}$ alcohols, produced for example from tallow or coconut oil, sodium and potassium alkyl $C_9$–$C_{20}$ benzene sulphonates, particularly sodium linear secondary alkyl $C_{10}$–$C_{15}$ benzene sulphonates; and sodium alkyl glyceryl ether sulphates, especially those ethers of the higher alcohols derived from tallow or coconut oil and synthetic alcohols derived from petroleum. The preferred anionic detergent compounds are sodium $C_{11}$–$C_{15}$ alkyl benzene sulphonates and sodium $C_{12}$–$C_{18}$ alkyl sulphates. Also applicable are surfactants such as those described in EP-A-328 177 (Unilever), which show resistance to salting-out, the alkyl polyglycoside surfactants described in EP-A-070 074, and alkyl monoglycosides.

Preferred surfactant systems are mixtures of anionic with nonionic detergent active materials, in particular the groups and examples of anionic and nonionic surfactants pointed out in EP-A-346 995 (Unilever). Especially preferred is surfactant system that is a mixture of an alkali metal salt of a $C_{16}$–$C_{18}$ primary alcohol sulphate together with a $C_{12}$–$C_{15}$ primary alcohol 3–7 EO ethoxylate.

The nonionic detergent is preferably present in amounts greater than 10%, e.g. 25–90% by weight of the surfactant system. Anionic surfactants can be present for example in amounts in the range from about 5% to about 40% by weight of the surfactant system.

The detergent composition may take any suitable physical form, such as a powder, granular composition, tablets, a paste or an anhydrous gel.

Enzymes

The detergent compositions of the present invention may additionally comprise one or more enzymes, which provide cleaning performance, fabric care and/or sanitation benefits.

Said enzymes include oxidoreductases, transferases, hydrolases, lyases, isomerases and ligases. Suitable members of these enzyme classes are described in Enzyme nomenclature 1992: recommendations of the Nomenclature Committee of the International Union of Biochemistry and Molecular Biology on the nomenclature and classification of enzymes, 1992, ISBN0-12-227165-3, Academic Press.

The composition may contain additional enzymes as found in WO 01/00768 A1 page 15, line 25 to page 19, line 29, the contents of which are herein incorporated by reference.

Builders, polymers and other enzymes as optional ingredients may also be present as found in WO0060045 .

Suitable detergency builders as optional ingredients may also be present as found in WO0034427 .

The composition of the present invention may be used for laundry cleaning, hard surface cleaning (including cleaning of lavatories, kitchen work surfaces, floors, mechanical ware washing etc.). As is generally known in the art, bleaching compositions are also employed in waste-water treatment, pulp bleaching during the manufacture of paper, leather manufacture, dye transfer inhibition, food processing, starch bleaching, sterilisation, whitening in oral hygiene preparations and/or contact lens disinfection.

In the context of the present invention, bleaching should be understood as relating generally to the decolourisation of stains or of other materials attached to or associated with a substrate. However, it is envisaged that the present invention can be applied where a requirement is the removal and/or neutralisation by an oxidative bleaching reaction of malodours or other undesirable components attached to or otherwise associated with a substrate. Furthermore, in the context of the present invention bleaching is to be understood as being restricted to any bleaching mechanism or process that does not require the presence of light or activation by light.

The invention will now be further illustrated by way of the following non-limiting examples:

EXAMPLES

Example 1

Synthesis of [(MeN4Py)FeCl]Cl

The licand N,N-bis(pyridin- 2-yl-methyl)-1,1-bis (pyridin-2-yl)-1-aminoethane (MeN4py) was prepared as described in EP 0 909 809 A2.

The ligand MeN4Py (33.7 g; 88.5 mmoles) was dissolved in 500 ml dry methanol. Small portions of $FeCl_2.4H_2O$ (0.95 eq; 16.7 g; 84.0 mmoles) were added, yielding a clear red solution. After addition, the solution was stirred for 30 minutes at room temperature, after which the methanol was removed (rotary-evaporator). The dry solid was ground and 150 ml of ethylacetate was added and the mixture was stirred until a fine red powder was obtained. This powder was washed twice with ethyl acetate, dried in the air and further dried under reduced pressure vacuum at 40° C. El. Anal. Calc. for $[Fe(MeN4py)Cl]Cl.2H_2O$: C 53.03; H 5.16; N 12.89; Cl 13.07; Fe 10.01%. Found C 52.29/52.03; H 5.05/5.03; N 12.55/12.61; Cl: 12.73/12.69; Fe: 10.06/10.01%.

Liquid formulation A was prepared with 0.03% of [Fe (MeN4py)Cl]Cl by adding 7.5 mg of the solid material in 25 ml liquid formulation A and optionally the anti-oxidant was added (resulting in 0.1%, 0.05% and 0.025%, unless denoted differently, in the formulation respectively). The mixture was stirred vigorously for 10 min and the liquids were then stored at 37° C.

The anti-oxidants employed were: BHT (2,6-di-t-butyl-4-methylphenol), Trolox (6-hydroxy-2,5,7,8-tetramethylchroman-2-carboxylic acid, Raluquin (1,2-dihydro-6-ethoxy-2,2,4-trimethylchinolin, vitamin C, Vitamin E (α-tocopherol), vitamin E-acetate (O-acetyl-α-tocopherol), and a mixture of 10% α, 45% δ- and 45% γ-tocopherol. The latter system was 70% pure; the values given in the table are corrected for this purity.

A SPME GC-MS analysis on a HP 6890 mass spectrometer (E.I.) (HP-1 column) was performed and some of the products analysed (e.g., no perfume components) are listed in the table below, after 1 day and after 6 days storage at 37° C. The intensities of the signals were integrated and the typical error in the determinations was around 5%.

The GC results depicted in Table 2 have been obtained by using a different set-up:A Fisons HRGC maga-2-series set-up using a Chrompack CP-SIL 5 CB column (50 m×0.32 mm, FD 1.2 μm) was used. 3-Hexanone was used as an internal-standard. The head-space analysis was done at 70° C.

The results presented in Table 2 are those of liquid formulations that have been stored at ambient conditions up till 7 weeks.

The GC-MS and GC results presented in tables 1 and 2 respectively depict a measure of stability of the unsaturated soap (detection of hexanal, heptanal and octanal) and of the iron catalyst in the formulation (pyridin-carboxyldehyde only for the results presented in Table 1).

Therefore in all cases a lower value means a better stability, as the system (unsaturated materials or catalyst) employs a greater stability.

Further the bleach performance on tomato-oil stains was assessed by using the method described below. The bleach performance experiments were done after 6 days storage of the liquid under ambient conditions.

Bottles tests were done (25 mL solution), each bottle containing two tomato stained cloths (4×4 cm). The cloths were washed for 30 min at 40° C. The dosage of formulation A was 5 g/l. The water hardness used was 24° FH. After the wash, the cloths were rinsed with water and subsequently dried, and the change in reflectance at 460 nm was measured immediately after drying on a Minolta CM-3700d spectrophotometer including a UV–Vis filter before and after treatment (denoted as t=0 in the table). Subsequently, the washed cloths were stored for 24 hrs in a dry dark cupboard at ambient conditions and the cloths were measured again (after-wash bleaching process), denoted as t=1 in the table. The difference in ΔR between both reflectance values gives a measure of the bleaching performance of the system on the stain, i.e. a higher ΔR value corresponds to an improved bleaching performance.

The results for bleaching performance are shown in table 1.

TABLE 1

Amounts of aldehydes detected by GC-MS and bleach results of the liquid detergent formulations containing catalyst and anti-oxidants. Liquids stored at 37° C.

| Experiment | Cat. | Antioxidant (% in formulation) | Days storage | Octanal | Heptanal | Hexanal | Pyridyl-carboxyl-aldehyde | ΔR (t = 0)* | ΔR (t = 1)* |
|---|---|---|---|---|---|---|---|---|---|
| 1 | – | — | 7 | 371 | 211 | 71 | 0 | 17 | 19 |
| 2 | + | — | 7 | 5114 | 3747 | 3181 | 195 | 25 | 34 |
| 3 | + | Raluquin (0.1) | 7 | 374 | 284 | 73 | 25 | 17 | 26 |
| 4 | + | Raluquin (0.1) | 14 | 632 | 302 | 130 | 43 | n.d. | n.d. |
| 5 | + | Trolox (0.1) | 7 | 361 | 233 | 104 | 24 | 19 | 24 |
| 6 | + | Trolox (0.1) | 14 | 741 | 413 | 335 | 32 | n.d. | n.d. |
| 7 | + | Tocopherol (0.1) | 1 | 529 | 183 | 83 | 28 | n.d. | n.d. |
| 8 | + | Tocopherol (0.1) | 7 | 3096 | 2181 | 3171 | 173 | 25 | 34 |
| 9 | + | Tocopherol-mix (0.17) | 7 | 325 | 231 | 143 | 21 | 20 | 24 |
| 10 | + | Tocopherol-mix (0.17) | 14 | 1135 | 341 | 516 | 40 | n.d. | n.d. |
| 11 | + | Tocopherol-acetate (0.1) | 1 | 3686 | 2441 | 5429 | 1221 | n.d. | n.d. |
| 12 | + | BHT (0.1) | 1 | 466 | 284 | 106 | 154 | n.d. | n.d. |
| 13 | + | BHT (0.1) | 6 | 2707 | 1775 | 2030 | 154 | 20 | 38 |
| 14 | + | Vitamin C (0.1) | 1 | 415 | 281 | 104 | 20 | n.d. | n.d. |
| 15 | + | Vitamin C (0.1) | 6 | 2472 | 1628 | 2081 | 614 | 23 | 35 |

*Liquid stored at room temperature for 6 days.

TABLE 2

Amounts of aldehydes detected by GC analysis of the liquid detergent formulations containing catalyst and anti-oxidants. Liquids stored at room temperature

| Experiment | Cat. | Antioxidant (% in formul.) | Weeks storage | Octanal | Heptanal | Hexanal |
|---|---|---|---|---|---|---|
| 16 | – | — | 7 | 0.16 | 0.05 | 0.20 |
| 17 | + | — | 7 | 0.75 | 1.16 | 4.64 |
| 18 | + | Raluquin (0.05) | 7 | 0.26 | 0.08 | 0.25 |
| 19 | + | Raluquin (0.1) | 7 | 0.20 | 0.07 | 0.27 |
| 20 | + | Trolox (0.05) | 7 | 0.25 | 0.17 | 0.95 |
| 21 | + | Trolox (0.1) | 7 | 0.27 | 0.10 | 0.40 |
| 22 | + | Tocopherol-mix (0.17) | 7 | 0.20 | 0.09 | 0.67 |

Composition formulation A:

| component | % |
|---|---|
| PAS | 10% |
| Nonionic surfactant, ethoxylated fatty alcohol type | 18.4% |
| Oleic acid | 10% |
| Deflocculating polymer, polymer All from EP346, 995 | 1% |

-continued

| Composition formulation A: | |
|---|---|
| component | % |
| Silicon oil to control foam | 0.03% |
| KOH | 4.1% |
| NaOH | 0.9% |
| Citric acid.H2O | 5.5% |
| Glycerol | 5% |
| Borax | 1.9% |
| Anti-dye transfer polymer | 0.3% |
| Protease | 0.3% |
| Lipolase | 0.37% |
| Amylase | 0.15% |
| Perfume | 0.47% |

From the results presented in the table, one can draw the following conclusions:

1. Addition of the iron catalyst leads to an increased formation of various aldehydes (octanal, heptanal, hexanal) as detected by GC-MS. Without being bound to theory, one can infer that these products are most likely formed due to degradation of the unsaturated soap present under storage conditions. This assumption was tested by preparing a liquid containing a fully saturated soap added. No detectable amounts of these aldehydes with the catalyst added were observed after 3 days storage.

2. Under the same conditions a clear signal of pyridylcarboxaldehyde was observed. Without being bound to theory, one can infer that this is most likely caused by decomposition of the iron catalyst during storage.

3. Addition of the following anti-oxidants BHT, vitamine C, Trolox, tocopherol (pure or mixtures) and Raluquin leads to a dramatic decrease of the amounts of aldehydes (octanal, heptanal, hexanal and pyridylcarboxaldehyde).

4. The performance of the liquid bleaching composition is stabilized whilst maintaining the bleach performance of the liquid bleaching composition.

5. The experiment with tocopherol acetate shows that a free phenolic site is preferred to exhibit the most efficient inhibition effect on aldehyde formation.

What is claimed is:

1. A bleaching composition comprising an organic ligand which forms a complex with a transition metal for bleaching a substrate with a group selected from:

a) atmospheric oxygen, the bleaching composition upon addition to an aqueous medium providing an aqueous bleaching medium substantially devoid of a peroxygen bleach or a peroxy-based or peroxyl-generating bleach system; and, b) a peroxygen bleach or source thereof, together with a surfactant having an allylic hydrogen, said surfactant having an HLB of greater than 2, and an antioxidant.

2. A bleaching composition according to claim 1, wherein the antioxidant is selected from the group consisting of: a phenol and an amine.

3. A bleaching composition according to claim 2, wherein the antioxidant is a hindered phenol.

4. A bleaching composition according to claim 3, wherein the antioxidant is selected from the group consisting of: di-tert-butyl hydroxy toluene, Ethoxyquine, α-tocopherol, and 6-hydroxy-2,5,7,8-tetra-methylchroman-2-carboxylic acid.

5. A bleaching composition according to claim 1, wherein the antioxidant is present in the composition in the range 0.001 to 10%.

6. A bleaching composition according to claim 1, wherein the surfactant is selected from the group of unsaturated neutral species.

7. A bleaching composition according to claim 1, wherein the surfactant is selected from the group of unsaturated zwitterionic species.

8. A bleaching composition according to claim 1, wherein the surfactant has an HLB of greater than 5.

9. A bleaching composition according to claim 8, wherein the surfactant has an HLB of greater than 10.

10. A bleaching composition according to claim 1, wherein the surfactant is present in the composition in an amount such that a unit dose provides at least 0.01 g/l concentration of the unsaturated organic compound in a wash.

11. A bleaching composition according to claim 1, wherein the surfactant has a hydrogen atom covalently bound to an alpha-carbon that is alpha to a Sp2—Sp2 hybridized bond, said hydrogen having a homclytic bond dissociation energy of less than 95 kcal/mol.

12. A bleaching composition according to claim 1, wherein the organic substance is present in the composition such that a unit dose provides at least 0.1 $\mu$M of the organic substance or transition metal complex thereof in a wash.

13. A bleaching composition according to claim 1, wherein the surfactant has a CMC of $2\times10^{-2}$ M or less.

14. A bleaching composition according to claim 1, wherein the surfactant is anionic and has a critical micelle concentration value of $3\times10^{-3}$ M or less.

15. A bleaching composition according to claim 1, wherein the surfactant has molecular weight of at least 80 and the allylic hydrogen has bond dissociation energy of less than 90 kcal/mol.

16. A bleaching composition according to claim 1, wherein the surfactant is present in the composition in the range of 0.01 to 60% wt/wt.

17. A bleaching composition according to claim 16, wherein the surfactant is present in the composition in the range of 0.1 to 20% wt/wt.

18. A bleaching composition according to claim 1, wherein the composition comprises a peroxyl source.

19. A bleaching composition according to claim 1, wherein the complex with atmospheric oxygen, and upon addition of the bleaching composition to an aqueous medium providing an aqueous bleaching medium substantially devoid of a peroxygen bleach or a peroxy-based or peroxyl-generating bleach system.

20. A bleaching composition according to claim 1, wherein the organic substance is N,N-bis(pyridin-2-yl-methyl)-1,1-bis(pyridin-2-yl)-1-aminoethane.

21. A bleaching composition for bleaching a substrate, the bleaching composition comprising:

(i) an organic ligand which forms a complex with a transition metal for bleaching with oxygen sourced from the air;

(ii) 0.01 to 60 wt/wt % of a surfactant having an HLB of greater than 15, the surfactant a sodium salt of an unsaturated carboxylic acid having an allylic hydrogen; and, (iii) 0.001 to 10% wt/wt % of a phenolic antioxidant present in the composition, said bleaching composition comprising less than 2% mMol of peroxide per Kg, wherein upon addition of the bleaching composition to an aqueous solution and in the presence of the substrate and least 10% of any bleaching of the substrate is effected by oxygen sourced from the air.

* * * * *